United States Patent [19]

Black

[11] Patent Number: 4,658,801

[45] Date of Patent: Apr. 21, 1987

[54] STOVE WITH MULTIPLE CHAMBERS

[76] Inventor: Alvin Black, 13130 NW. Lovejoy, Portland, Oreg. 97229

[21] Appl. No.: 849,496

[22] Filed: Apr. 8, 1986

[51] Int. Cl.[4] ..... F24C 1/14

[52] U.S. Cl. ..... 126/77; 126/76; 126/83; 126/289; 110/214

[58] Field of Search ..... 126/58, 60, 72, 76, 126/77, 83, 193, 285 R, 289; 110/210, 211, 214; 422/177

[56] References Cited

U.S. PATENT DOCUMENTS

| | | | |
|---|---|---|---|
| 4,319,556 | 3/1982 | Schwartz et al. | 126/77 |
| 4,380,228 | 4/1983 | Crowley | 126/76 |
| 4,404,953 | 9/1983 | Thulman et al. | 126/77 |
| 4,432,335 | 2/1984 | Kilham | 126/60 |
| 4,437,451 | 3/1984 | Wysong | 126/77 |
| 4,458,662 | 7/1984 | Barnett | 126/77 |
| 4,479,921 | 10/1984 | Allaire et al. | 126/77 X |
| 4,582,045 | 4/1986 | Dorau et al. | 126/77 X |

*Primary Examiner*—Margaret A. Focarino

*Attorney, Agent, or Firm*—Dellett, Smith-Hill and Bedell

[57] ABSTRACT

A stove comprises walls defining a main air inlet, a flue outlet and four chambers through which gas passes sequentially from the main air inlet to the flue outlet during normal operation of the stove. The chambers comprise a pre-heat plenum chamber into which the main air inlet opens, a main combustion chamber for containing solid fuel to be burned and into which gas passes from the pre-heat plenum chamber, a second combustion chamber which is downstream of the main combustion chamber with respect to the flow of gas from the main air inlet to the flue outlet, and a third combustion chamber from which the combustion gas outlet opens.

23 Claims, 5 Drawing Figures

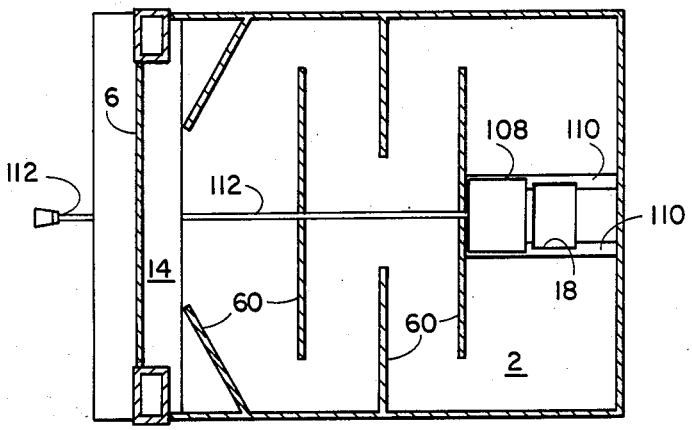
FIG. 3
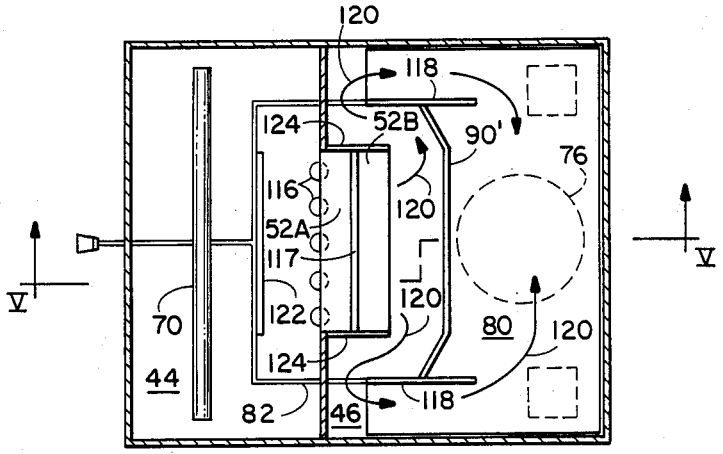
FIG. 4
FIG. 5
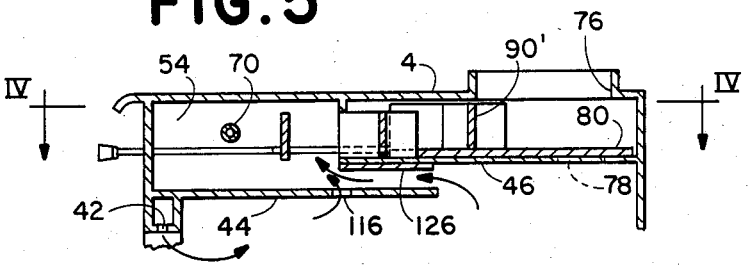

STOVE WITH MULTIPLE CHAMBERS

This invention relates to a stove with multiple chambers.

BACKGROUND OF THE INVENTION

It is common to use a wood stove as a source of home heat, and extensive efforts have been made to improve the heat output of wood stoves and to reduce the amount of pollution generated through use of such stoves. These goals are not inconsistent, in that a substantial portion of the pollutants generated by a wood stove are combustible, and therefore by ensuring more complete combustion the quantity of pollutants is reduced and additional heat is released.

U.S. Pat. No. 4,319,556 (Schwartz et al) discloses a wood burning stove having four chambers through which gas passes successively from an air inlet of the stove to a flue outlet. Only the second and third of these chambers are combustion chambers, the fourth chamber being a heat exchange chamber.

U.S. Pat. No. 4,432,335 (Kilham) discloses a wood burning stove having ducts for introducing air into the combustion chamber in a downwards direction.

SUMMARY OF THE INVENTION

A preferred stove embodying the invention comprises walls defining a main air inlet, a flue outlet and four chambers through which gas passes sequentially from the main air inlet to the flue outlet during normal operation of the stove. The chambers comprise a pre-heat plenum chamber into which the main air inlet opens, a main combustion chamber for containing solid fuel to be burned and into which gas passes from the pre-heat plenum chamber, a second combustion chamber which is downstream of the main combustion chamber with respect to the flow of gas from the main air inlet to the flue outlet, and a third combustion chamber from which the combustion gas outlet opens.

BRIEF DESCRIPTION OF THE DRAWINGS

For a better understanding of the invention, and to show how the same may be carried into effect, reference will now be made, by way of example, to the accompanying drawings in which:

FIG. 3 is a horizontal sectional view of the FIG. 1 stove taken on the line III—III of FIG. 2, FIG. 4 is a sectional view of a scond domestic stove embodying the present invention, taken on the line IV—IV of FIG. 5, and FIG. 5 is a partial sectional view of the second stove, taken on the line V—V of FIG. 4.

DETAILED DESCRIPTION

Figure 1:
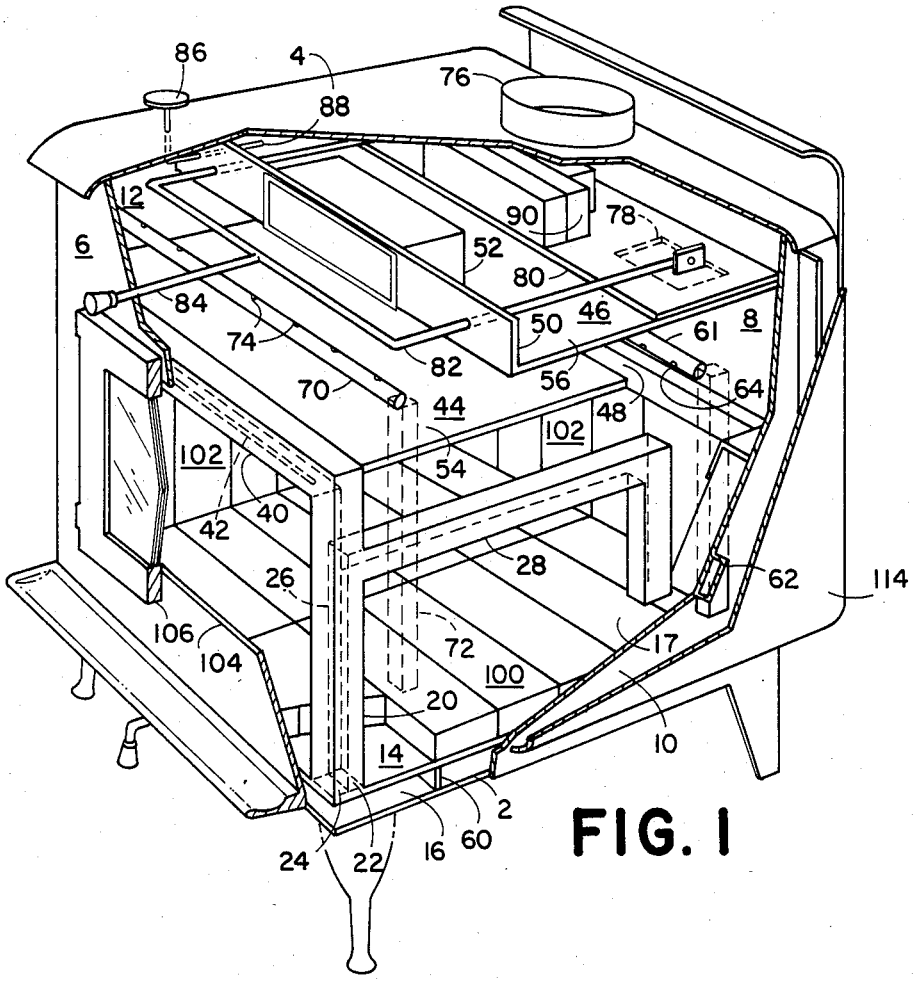
FIG. 1 is a perspective, partially cut away view of a domestic stove embodying the present invention.
Figure 2:
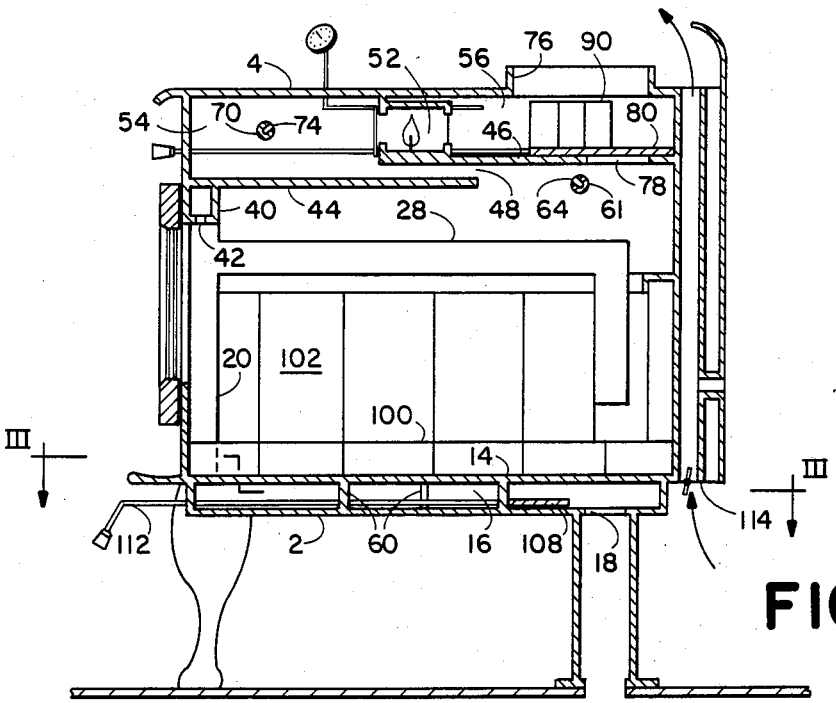
FIG. 2 is a vertical sectional view of the FIG. 1 stove.

The domestic stove illustrated in FIGS. 1–3 comprises an enclosure having bottom and top walls 2 and 4, front and rear walls 6 and 8 and side walls 10 and 12. These exterior walls define a major chamber that is subdivided into several smaller chambers. The front wall 6 is formed with an opening 104 that is normally closed by means of a door 106 which is hingedly mounted to the wall 6. A lower wall 14, spaced slightly from the bottom wall 2, defines the top of a pre-heat plenum chamber 16 and the bottom of a main combustion chamber 17. The main combustion chamber is partially lined with fire brick that is in a bottom layer 100 and a side layer 102. Solid fuel to be burned is introduced into the main combustion chamber 17 through the opening 104 and is place either on the bottom fire-brick layer 100 or in a grate (not shown). The fuel is lit and forms a fire in the main combustion chamber.

The bottom wall 2 of the stove enclosure is formed with a main air inlet opening 18 for admitting combustion air into the plenum chamber. A valve plate 108 is slidable in tracks 110 under control of a rod 112 for opening and closing the air inlet opening 18. Combustion air leaves the plenum chamber by way of rectangular section pipes 20 that extend upwardly from the lower wall 14 in the corners defined between the front wall 6 and the side walls 10 and 12. The interior of each of the pipes 20 is divided into two ducts 22 and 24 by a plate 26. The duct 22 communicates with the interior of a second rectangular section pipe 28 having a horizontal portion that extends toward the back wall 8 from the pipe 20 and a vertical portion that extends downwardly from the rear end of the horizontal portion and opens downwardly at a position somewhat above the bottom layer 100 of fire-brick. The ducts 20 communicate with opposite ends of a horizontal pipe 40 which has a slot-form opening 42 in its underside. The underside of the pipe 40 is at substantially the same level as the upper edge of the opening 104 formed in the front wall 6. A horizontal plate 44 extends from the pipe 40 towards the rear wall 8, and a horizontal plate 46 extends from the rear wall 8 towards the front wall 6 at a level somewhat above the plate 44. A restricted throat 48 is defined between the plates 44 and 46, and thus the plates 44 and 46 define the top of the main combustion chamber. A ledge 50 extends upwardly from the forward edge of the plate 46 and meets the underside of the top wall 4. The ledge 50 is formed with a rectangular opening in which a catalytic converter 52 is fitted. The catalytic converter is of conventional form. The space defined above the plate 44 and forward of the throat 48 and the ledge 50 forms a second combustion chamber 54, whereas the space defined above the plate 46 and to the rear of the ledge 50 forms a third combustion chamber 56.

Vertical baffle plates 60 extend in the pre-heat plenum chamber 16 between the walls 2 and 14. These plates are heated by conduction from the fire in the main combustion chamber, and consequently the air passing from the inlet 18 and entering the pipes 20 is pre-heated. Further pre-heating takes place as the air passes through the pipes 20, 28 and 40 prior to entering the main combustion chamber. In the main combustion chamber, the air supports combustion of the solid fuel that is located in the main combustion chamber. When using wood as the fuel, temperatures as high as 1000 degrees F. are obtained in the main combustion chamber and the pre-heating is such that during normal operation the air entering the main combustion chamber by way of the pipes 28 is over 600 degrees F. whereas the air entering by way of the slot 42 is at a temperature of over 500 degrees F. Consequently, the combustion air entering the main combustion chamber is pre-heated to a sufficient temperature for burning dry wood, and this enables a higher temperature to be reached in the main combustion chamber that can be achieved without substantial preheating of the combustion air, with the result that more complete combustion of solid components of the fuel takes place.

All combustion air that is introduced into the main combustion chamber enters from above, instead of passing upwardly through the burning fuel. Consequently, the oxygen in the combustion air is used preferentially for supporting burning of combustible material in the gases leaving the fire, instead of being depleted of oxygen by virtue of its having passed through the burning fuel so that little or no oxygen is available in the space above the fire.

The gases leaving the immediate area of the fuel are rich in combustible materials such as creosote, carbon monoxide and particulate materials, but are relatively poor in oxygen. In order to promote combustion of those materials, additional air is introduced into the flow of gases leaving the main combustion chamber by means of a pipe 61 which extends just below the plate 46 and about halfway between the plate 44 and the rear wall 8. The pipe 61, which has holes 64 in its wall, is connected at its opposite ends to ducts 62 which extend upwardly along the side walls 10 and 12. The draft of gases leaving the combustion chamber draws air into the pipe 61 by way of the ducts 62, and this air is preheated as it passes along the duct 62. The pre-heated air leaves the pipe 61 through the holes 64 and enters the flow of gases leaving the combustion chamber 17 by way of the throat 48.

In the chamber 54, creosote is burned and the temperature reaches about 1200 degrees F. Additional preheated air is introduced into the chamber 54 by way of a pipe 70 that is similar to the pipe 61. The pipe 70 receives pre-heated air by way of ducts 72 and introduces it into the chamber 54 by way of holes 74. During normal operation, gases from the chamber 54 enter the chamber 56 by way of the catalytic converter 52. The catalytic converter is a conventional device manufactured by Corning Glassworks and comprises a body of ceramic material having passageways extending therethrough. The surfaces of the ceramic material that bound the passages are coated with a catalyst that promotes oxidation of carbon monoxide and other combustible gases. Therefore, as combustion gases and added air pass through the catalytic converter from the chamber 54 to the chamber 56, combustible material in the gases is oxidized and additional heat is released. Gases leave the chamber 56 by way of the flue outlet 76.

The catalytic converter forms a resistance to flow of gases from the chamber 54 to the chamber 56, and when the fire is first lit in the main combustion chamber the draft may not be sufficient to overcome that resistance, and consequently insufficient air might be drawn into the combustion chamber and the fire might be extinguished. In order to avoid this possibility, the plate 46 is formed with by-pass openings 78 and a control plate 80 rests on the plate 46. A generally U-shaped rod 82 is connected at its two opposite ends to the plate 80, and the two limbs of the U extend through respective holes in the ledge 50. A rod 84 is connected to the base of the U and extends through a hole in the front wall 6. A temperature indicator 86 has its sensor probe 88 in the chamber 54. When the fire is first lit, the rod 84 is pulled forwards so that the plate 80 exposes the openings 78. The gases from the main combustion chamber then pass to the chamber 56 without passing through the chamber 54. The openings 78 are sufficiently large that they do not substantially impede flow of gas from the main combustion chamber into the chamber 56, and therefore the fire is readily established. When the fire is burning properly, as determined by observing that the temperature in the chamber 56 has reached an appropriate level, the bar 84 is pushed backwards, and the plate 80 covers the openings 78. The catalytic converter 52 is thereby placed in the path of combustion gases leaving the main combustion chamber.

The plate 80 carries a heat reflecting block 90 of stainless steel. The block 90 is heated by gases in the chamber 56 and by radiation from the catalytic converter 52, and radiates heat towards the catalytic converter so that the catalytic converter remains at a uniform high temperature. Catalytic oxidation of carbon monoxide and other partially oxidized combustion materials is thereby promoted. During the start-up, while the openings 78 are uncovered, the block 90 covers the exit face of the catalytic converter and therefore positively prevents a parallel flow of gas from the chamber 17 to the chamber 56 by way of the passages in the catalytic converter. This insures that the coated surfaces of the catalytic converter do not become contaminated with condensate from the combustion gases and thus preserves the efficiency of the catalytic converter. As noted previously, air from the duct 24 leaves the pipe 40 by way of the slot 42, which is close to the door 106. The flow of air from the slot 42 keeps combustion gases away from the glass panel in the door, and consequently the glass remains clean. Moreover, air passing through the slot 42 inhibits billowing of smoke from the main combustion chamber when the door is opened and the pressure in front of the opening 104 is reduced. Use of the two separate ducts 24 and 26 ensures that a reverse flow of gas through the pipe 28 and into the pipe 40 is not established when the door is opened.

The stove is provided with a jacket 114 covering the walls 8, 10 and 12 in spaced relationship. Air passes through the space defined between the walls 8, 10, 12 and the jacket 114 by convection, and is heated by contact with the walls of the stove.

In the stove shown in FIGS. 4 and 5, openings 116 are provided in the plate 44, immediately below the forward edge of the plate 46. As gas passes through the throat 48 to the chamber 54, gas is drawn through the openings 116. The gas that passes through the openings 116 is mixed turbulently with the gas passing through the throat. A major part of the gas that is drawn through the openings 116 is air that enters the main combustion chamber 17 by way of the opening 42. Therefore, the gas entering the chamber 54 is well mixed and contains sufficient oxygen to support complete oxidation of combustible materials.

Through use of the openings 116, the pressure with which gas enters the chamber 54 is increased as compared with the FIGS. 1–3 stove. The impedance of a single catalytic converter is too low to ensure adequate contact time of the gas from the chamber 54 with catalyst material, and therefore the FIGS. 4 and 5 stove comprises two catalytic converters 52A and 52B connected in series. A small space 117, about 0.25 inch (0.635 cm) wide, is provided between the catalytic converters 52A and 52B in order to optimize the impedance of the catalytic converters.

In order to increase still further the residence time of gas in the catalytic converters 52A and 52B, the reflecting block 90 of the FIGS. 1–3 stove is replaced in the FIGS. 4 and 5 stove by a reflecting baffle plate 90' that is made of stainless steel and is attached to the plate 80. The top of the plate 90' just clears the top wall 4 of the stove. Additional flow-deflecting plates 118 are placed at the two ends of the plate 90'. During normal operation, the plate 90' is located close to the forward edge of the flue opening 76 and therefore gas from the catalytic converters 52A and 52B cannot pass directly to the flue opening 76 but must flow around the plate 90' and 118, along the paths indicated by the arrows 120.

The plate 90' is concave towards the converter 52B, so as to collect energy radiating from the converter and reflect it back towards the converter. In order to limit loss of energy by radiation towards the front on the converter 52A, a plate 122 of stainless steel is mounted on the center portion of the rod 82. The plate is perforated, and therefore it does not interfere excessively with the flow of air from the pipe 70 towards the converter 52A. Metal plates 124 and 126 are provided at the sides of the converters 52A and 52B and underneath the converters. These plates absorb heat from the converters during normal operation of the stove and act as a source of heat when the gas flowing to the converters cools down, e.g. when the door (not shown in FIGS. 4 and 5) is opened, so as to limit variations in the temperature of the converters.

It will be appreciated that the present invention is not restricted to the particular stove that has been described and illustrated, and that variations may be made therein without departing from the scope of the invention as defined in the appended claims and equivalents thereof. For example, the catalytic converter although preferred, is not essential to satisfactory operation of the stove.

I claim:

1. A stove for burning a solid fuel such as wood, comprising wall means defining a main air inlet, a combustion gas outlet, and four chambers through which gas passes sequentially from the main air inlet to the combustion gas outlet, said chambers comprising a pre-heat plenum chamber into which the main air inlet opens, a main combustion chamber for containing solid fuel to be burned and into which gas passes from the pre-heat plenum chamber, a second combustion chamber which is downstream of the main combustion chamber with respect to the flow of gas from the main air inlet to the combustion gas outlet, and a third combustion chamber from which the combustion gas outlet opens, and the stove also comprising a plate having a restricted opening for providing communication between the second and third combustion chambers, and a catalytic converter comprising a body of solid material formed with passageways, said body of solid material being fitted in said restricted opening so that gas passes from the second combustion chamber to the third combustion chamber by way of the passageways in said body.

2. A stove according to claim 1, comprising a duct for delivering air to the second combustion chamber without contacting material in the main combustion chamber.

3. A stove according to claim 1, comprising a heat reflecting member disposed in the vicinity of the catalytic converter for maintaining the catalytic converter at a uniform high temperature.

4. A stove according to claim 3, comprising by-pass means for conducting gas from the main combustion chamber to the third combustion chamber without passing through the second combustion chamber, and wherein the heat reflecting member is mounted so as to be slidable between a first position in which it obstructs the passageways of the catalytic converter and a second position in which it is spaced from the catalytic converter and leaves said passageways substantially unobstructed.

5. A stove according to claim 4, wherein the third combustion chamber is separated from the main combustion chamber by a stationary, substantially horizontal plate and the by-pass means comprise at least one hole in the stationary plate, and wherein the heat reflecting member is mounted on a slidable plate that rests on the stationary plate so that in the first position of the heat reflecting member the slidable plate leaves the hole in the stationary plate substantially unobstructed and in the second position of the heat absorbing block the slidable plate blocks the hole in the stationary plate.

6. A stove according to claim 3, wherein the heat reflecting member is a block of metal having a reflective surface presented towards the catalytic converter.

7. A stove according to claim 3, wherein the heat reflecting member is a plate of metal having a reflective surface presented towards the catalytic converter.

8. A stove according to claim 3, wherein the heat reflecting member is concave towards the catalytic converter.

9. A stove according to claim 3, wherein the heat reflecting member is a plate of metal disposed in the second combustion chamber and having a reflective surface presented towards the catalytic converter.

10. A stove according to claim 9, further comprising an air-delivery pipe extending within the second combustion chamber and having openings for introducing air into the second combustion chamber, and wherein the plate of metal is disposed between the air-delivery pipe and the catalytic converter and is perforated.

11. A stove according to claim 9, comprising a second heat reflecting member disposed in the third combustion chamber, and means coupling the two heat-reflecting members together for movement relative to the catalytic converter.

12. A stove according to claim 1, further comprising baffle means for impeding flow of gas through the third combustion chamber.

13. A stove according to claim 12, wherein the baffle means include a heat reflecting member disposed in the third combustion chamber in the vicinity of the catalytic converter.

14. A stove according to claim 1, comprising a second catalytic converter disposed in spaced relationship with respect to the first-mentioned catalytic converter and downstream of the first-mentioned catalytic converter with respect to the direction of flow of gas from the second combustion chamber to the third combustion chamber.

15. A stove according to claim 1, comprising heat-absorbing members in thermally-conductive contact with the catalytic converter for absorbing heat emitted by the catalytic converter.

16. A stove according to claim 1, comprising a first plate extending between the main combustion chamber and the second combustion chamber, and a second plate extending between the main combustion chamber and the third combustion chamber, the second plate being substantially parallel to the first plate and spaced therefrom to define a throat through which gas flows from the main combustion chamber to the second combustion chamber, and wherein the first plate is formed with at least one restricted opening providing communication between the main combustion chamber and the second combustion chamber at a location close to the downstream end of the throat.

17. A stove according to claim 1, wherein the pre-heat plenum chamber is disposed beneath the main combustion chamber, and the stove also comprises air delivery means for delivering air from the pre-heat plenum chamber to the main combustion chamber in a downwards direction from a location above the bottom of the main combustion chamber.

18. A stove for burning a solid fuel such as wood, comprising wall means defining a main air inlet, a combustion gas outlet, and four chambers through which gas passes sequentially from the main air inlet to the combustion gas outlet, said chambers comprising a pre-heat plenum chamber into which the main air inlet opens, a main combustion chamber for containing solid fuel to be burned and into which gas passes from the pre-heat plenum chamber, a second combustion chamber which is downstream of the main combustion chamber with respect to the flow of gas from the main air inlet to the combustion gas outlet, and a third combustion chamber from which the combustion gas outlet opens, wherein the pre-heat plenum chamber is disposed beneath the main combustion chamber, and the stove also comprises air delivery means for delivering air from the pre-heat plenum chamber to the main combustion chamber in a downwards direction from a location above the bottom of the main combustion chamber, said air delivery means comprising a pipe having a first part that passes upwards from the pre-heat plenum chamber through the main combustion chamber, a second part that passes substantially horizontally within the main combustion chamber, and a third part that passes downwards within the main combustion chamber and opens into the main combustion chamber at a location above the bottom of the main combustion chamber.

19. A stove according to claim 18, wherein the wall means include a front wall that is formed with an opening, and a door for normally closing the opening, and wherein the air delivery means further comprise a second pipe extending substantially horizontally from the upper end of the first part of the first pipe, the second pipe being located adjacent the front wall at the top of the opening, and being formed with a longitudinally extending outlet.

20. A stove according to claim 18, comprising a plate having a restricted opening for providing communication between the second and third combustion chambers, a first catalytic converter comprising a body of solid material formed with passageways, said body of solid material being fitted in said restricted opening so that gas passes from the second combustion chamber to the third combustion by war of the passageways in said body, and a second catalytic converter disposed in spaced relationship with respect to the first catalytic converter and downstream of the first catalytic converter with respect to the direction of flow of gas from the second combustion chamber to the third combustion chamber.

21. A stove for burning a solid fuel such as wood, comprising wall means defining a main air inlet, a combustion gas outlet, and four chambers through which gas passes sequentially from the main air inlet to the combustion gas outlet, said chambers comprising a pre-heat plenum chamber into which the main air inlet opens, a main combustion chamber for containing solid fuel to be burned and into which gas passes from the pre-heat plenum chamber, a second combustion chamber which is downstream of the main combustion chamber with respect to the flow of gas from the main air inlet to the combustion gas outlet, and a third combustion chamber from which the combustion gas outlet opens, and the stove also comprising a first plate extending between the main combustion chamber and the second combustion chamber, and a second plate extending between the main combustion chamber and the third combustion chamber, the second plate being substantially parallel to the first plate and spaced therefrom to define a throat through which gas flows from the main combustion chamber to the second combustion chamber, and wherein the first plate is formed with at least one restricted opening providing communication between the main combustion chamber and the second combustion chamber at a location close to the downstream end of the throat.

22. A stove according to claim 21, comprising a plate having a restricted opening for providing communication between the second and third combustion chambers, a first catalytic converter comprising a body of solid material formed with passageways, said body of solid material being fitted in said restricted opening so that gas passes from the second combusion chamber to the third combustion chamber by way of the passageways in said body, and a second catalytic converter disposed in spaced relationship with respect to the first catalytic converter and downstream of the first catalytic converter with respect to the direction of flow of gas from the second combustion chamber to the third combustion chamber.

23. A stove for burning solid fuel such as wood, comprising wall means defining a main air inlet, a combustion gas outlet, and four chambers through which gas passes sequentially from the main air inlet to the combustion gas outlet, said chambers comprising a pre-heat plenum chamber into which the main air inlet opens, a main combustion chamber for containing solid fuel to be burned and into which gas passes from the preheat plenum chamber, a second combustion chamber which is downstream of the main combustion with respect to the flow of gas from the main air inlet to the combustion gas outlet, and a third combustion chamber from which the combustion gas outlet opens, wherein the wall means include a front wall that is formed with an opening for introducing solid fuel into the main combustion chamber, and a door that is selectively positionable to close the opening, the door including a panel of transparent material, and the pre-heat plenum chamber is disposed beneath the main combustion chamber, and the stove also comprises a pipe having a first part that passes upwards from the pre-heat plenum chamber through the main combustion chamber and a second part that passes over the opening in the wall means and opens downwards into the main combustion chamber at a location adjacent the upper edge of the opening.

* * * * *